US010941913B1

(12) United States Patent
Robinson et al.

(10) Patent No.: US 10,941,913 B1
(45) Date of Patent: Mar. 9, 2021

(54) ELECTRONIC CANDLE

(71) Applicant: ILLUMOCITY LLC, Hunts Point, WA (US)

(72) Inventors: David M. Robinson, Hunts Point, WA (US); Merritt James Tennison, Seattle, WA (US); Elijah E. Hooper, Seattle, WA (US); Guy Paolo Corral, Seattle, WA (US); Mark Taylor, Seattle, WA (US); Sonja Takatori, Mukilteo, WA (US); Joseph M. Vernaci, II, Edmonds, WA (US); Paul T. Hinrichs, Seattle, WA (US); Kyle S. Johnston, Sammamish, WA (US)

(73) Assignee: ILLUMOCITY LLC, Hunts Point, WA (US)

( * ) Notice: Subject to any disclaimer, the term of this patent is extended or adjusted under 35 U.S.C. 154(b) by 0 days.

(21) Appl. No.: 16/854,620

(22) Filed: Apr. 21, 2020

(51) Int. Cl.

| | |
|---|---|
| ***F21V 1/00*** | (2006.01) |
| ***F21S 10/04*** | (2006.01) |
| ***F21S 6/00*** | (2006.01) |
| ***F21V 3/04*** | (2018.01) |
| ***F21S 9/02*** | (2006.01) |
| *F21Y 115/10* | (2016.01) |
| *F21W 121/00* | (2006.01) |

(52) U.S. Cl.
CPC ..... *F21S 10/043* (2013.01); *F21S 6/001* (2013.01); *F21S 9/02* (2013.01); *F21V 3/049* (2013.01); *F21W 2121/00* (2013.01); *F21Y 2115/10* (2016.08)

(58) Field of Classification Search
CPC . F21S 10/043; F21S 9/02; F21S 6/001; F21V 3/049; F21Y 2115/10; F21W 2121/00
USPC ..... 362/235
See application file for complete search history.

(56) References Cited

U.S. PATENT DOCUMENTS

| | | | |
|---|---|---|---|
| 3,749,904 | A | 7/1973 | Graff |
| 5,097,180 | A | 3/1992 | Ignon |
| 6,066,924 | A | 5/2000 | Lederer |
| 6,719,443 | B2 | 4/2004 | Gutstein |
| 7,029,146 | B2 | 4/2006 | Kitchen |
| 7,332,878 | B1 | 2/2008 | Smith |
| 7,391,182 | B2 | 6/2008 | Barbeau |
| 7,686,471 | B2 | 3/2010 | Reichow |
| 8,132,936 | B2 | 3/2012 | Patton |
| 8,210,708 | B2 | 7/2012 | Hau |
| 8,602,632 | B1 | 12/2013 | Poon |

(Continued)

*Primary Examiner* — Ali Alavi
(74) *Attorney, Agent, or Firm* — Lowe Graham Jones PLLC

(57) ABSTRACT

An electronic candle produces light using light emitting diodes (LEDs) or other electronic sources of light, rather than a flame, and is intended to operate the LEDs in a fashion that simulates a burning candle. The electronic candle includes a base and LEDs within a bulb and surrounded by a dome to provide a diffusing effect for light generated within the electronic candle. A memory accessible by a processor contains stored programming instructions causing the LEDs to illuminate under control of the processor, in accordance with particular modes of operation, varying from one mode to another after brief periods of time and in a random way. Each mode defines an apparent flame position having a radial position, angular position, and intensity of the simulated flame.

21 Claims, 8 Drawing Sheets

(56) References Cited

U.S. PATENT DOCUMENTS

| | | | | |
|---|---|---|---|---|
| 9,068,706 | B2 | 6/2015 | Fournier | |
| 9,074,759 | B2 | 7/2015 | Lai | |
| 9,341,342 | B2 | 5/2016 | Chiang | |
| 9,518,710 | B2 | 12/2016 | Li | |
| 9,551,470 | B2 | 1/2017 | Li | |
| 9,572,236 | B2 | 2/2017 | Patton | |
| 9,585,980 | B1 | 3/2017 | Li | |
| 9,605,824 | B1 | 3/2017 | Li | |
| 9,625,112 | B2 | 4/2017 | Li | |
| 9,689,538 | B2 | 6/2017 | Hau | |
| 9,719,643 | B1 | 8/2017 | Cheng | |
| 9,739,432 | B2 | 8/2017 | Li | |
| 9,756,707 | B2 | 9/2017 | Patton | |
| 9,810,388 | B1 | 11/2017 | Li | |
| 9,909,729 | B2 | 3/2018 | Dong | |
| 9,914,145 | B2 * | 3/2018 | Osborn | B05B 17/0615 |
| 10,010,640 | B1 | 7/2018 | Li | |
| 10,111,307 | B2 | 11/2018 | Li | |
| 2015/0259078 | A1 * | 9/2015 | Filipovic | F21K 9/20 244/114 R |
| 2016/0327227 | A1 * | 11/2016 | Green, Jr. | F21S 10/043 |

* cited by examiner

| | radial | | | | | |
|---|---|---|---|---|---|---|
| | div | | span | | offset | |
| | min | max | min | max | min | max |
| 0 | 60 | 80 | 0 | 15 | 20 | 45 |
| 1 | 10 | 15 | 50 | 80 | 40 | 50 |
| 2 | 35 | 45 | 25 | 60 | 40 | 50 |
| 3 | 0 | 0 | 0 | 0 | 0 | 0 |

Fig. 7

| | angle | | | | | |
|---|---|---|---|---|---|---|
| | div | | span | | offset | |
| | min | max | min | max | min | max |
| 0 | 120 | 170 | 75 | 120 | 0 | 360 |
| 1 | 400 | 600 | 0 | 360 | 0 | 360 |
| 2 | 250 | 300 | 0 | 360 | 0 | 360 |
| 3 | 0 | 0 | 0 | 0 | 0 | 0 |

Fig. 8

| | intensity | | | | | |
|---|---|---|---|---|---|---|
| | div | | span | | offset | |
| | min | max | min | max | min | max |
| 0 | 40 | 60 | 0 | 10 | 80 | 80 |
| 1 | 8 | 20 | 40 | 60 | 50 | 80 |
| 2 | 30 | 50 | 20 | 30 | 65 | 70 |
| 3 | 0 | 0 | 0 | 0 | 0 | 0 |

Fig. 9

| | dur | | prb | mod |
|---|---|---|---|---|
| | min | max | | |
| 0 | 1 | 4 | 40 | 42 |
| 1 | 2 | 4 | 20 | 42 |
| 2 | 1 | 4 | 40 | 42 |
| 3 | 0 | 0 | 0 | 0 |

Fig. 10

ELECTRONIC CANDLE

FIELD OF THE INVENTION

The subject matter of this patent relates to lighting systems which imitate a burning candle, including methods of operating such lighting in order to produce an appearance that imitates a candle.

BACKGROUND OF THE INVENTION

Candles are commonly used for the light they produce by a burning flame, and also for the soothing or therapeutic effect which is provided by the flame. In many environments such as in hospitals or nursing homes it may be desirable to burn genuine candles for these effects, but it is impractical or unsafe to do so.

Others have attempted to produce electronic candles which are intended to provide light similar to that of a candle, or in an aesthetic housing which looks like a wax candle, but with mixed results. Though it is possible to produce a simulated wax candle, it is not so easy to produce light from an electronic source that behaves the way a candle flame behaves, so that it looks like it is a burning flame.

One example is in U.S. Pat. No. 9,572,236 to Patton. In this patent, Patton teaches the use of a "projection screen" that may be in the shape of a flame in order to try to resemble a flame. A light bulb shines light onto the projection screen while a fan, magnet, or other source causes the projection screen to move the way a flame might move.

Another example is in U.S. Pat. No. 9,341,342 to Chiang. In this patent, Chiang teaches that a colored lens LED is to be placed inside a simulated wick which is generally cylindrical in shape. Chiang states that the LED simulates a candle but does not teach a method of controlling LEDs in a way that can simulate the movement and flicker of an actual flame. Instead, Chiang is mostly concerned with providing a simulated wick which is black in appearance when the device is off.

Yet another example is in U.S. Pat. No. 8,602,632 to Poon, who teaches an electronic candle which supposedly mimics a candle flame. Poon describes a single "lighting element" atop a simulated wick assembly. An air pressure sensor is provided in order to detect changes in air pressure such as that caused by a user blowing on the wick. The system then responds to the change in air pressure to alter the emitted light in some fashion, assertedly mimicking a true candle flame.

Though the above examples seek to simulate a light that theoretically mimics a candle flame, none of them truly achieve it. Instead, they produce a result that remains quite different from that of a true candle, and which provides a mechanical and artificial quality of light.

SUMMARY OF THE INVENTION

An electronic candle produces light using light emitting diodes (LEDs) or other electronic sources of light, rather than a flame, and is intended to operate the LEDs in a fashion that simulates a burning candle. One version of the electronic candle includes a base which is preferably cup-shaped as with a small cylinder that might hold a tea light or other small candle. The preferred electronic candle also includes a dome, which is preferably formed from glass or plastic which may be frosted or otherwise configured to provide a diffusing effect for light generated within the electronic candle. In one version, the dome is frosted on an interior surface and is therefore semi-transparent so that the dome is illuminated and creates a sense of glowing while the LEDs are illuminated. An inner bulb may be formed from similar materials in order to diffuse the light from the LEDs, and is intended to create the appearance of a filament or a burning wick, providing an area of concentration of light in the space within the outer dome.

A memory accessible by a processor contains stored programming instructions causing the LEDs to illuminate under control of the processor, which in a preferred version is in accordance with exemplary modes defined by stored data. Actual flame candles have movement of the flame which may vary between different modes, including a quiet mode of slow movement within a constrained range, a windblown mode characterized by fast changes in direction and intensity, an oscillating mode with quick changes in intensity but little directional movement, and a gentle mode with moderate changes in position and intensity. A candle may move in a manner consistent with one of these modes for a period between a second or two to perhaps several seconds, then change to a different mode and thereafter continue changing to varying modes of illumination for such brief periods of time. In one version of the invention, the memory contains data used to control the illumination of the LEDs in accordance with such modes by controlling the apparent radial position, angular position, and intensity of the simulated flame, and further to control the selection of a particular mode of operation and the duration of that mode.

An exemplary electronic candle includes a base, a plurality of peripheral light emitting diodes arranged to surround a central light emitting diode, a bulb covering the plurality of peripheral light emitting diodes and the central light emitting diode, and a processor coupled to the plurality of peripheral light emitting diodes and the central light emitting diode, the processor having stored programming instructions to control the illumination of the plurality of peripheral light emitting diodes and the central light emitting diode. Preferably, the electronic candle includes an apparent flame position defined as a center of light intensity produced by the combination of the plurality of peripheral light emitting diodes and the central light emitting diode, and further wherein the stored programming instructions are operable by the processor to vary the location of the apparent flame position by controlling the intensity of illumination of the plurality of peripheral light emitting diodes and the central light emitting diode.

In another version, the stored programming instructions are further operable by the processor to control an angular position, a radial position, and the overall intensity of the apparent flame position.

In some versions of the invention, the angular position is defined by an angular position parameter which is defined by stored angular position data accessible by the processor in which the angular position data includes an angular position offset and an angular position span, such that the angular position is variable between the angular position offset plus the angular position span to the angular position offset minus the angular position span. Most preferably, the angular position varies at an angular position frequency.

Likewise, in some versions of the invention, the radial position is defined by a radial position parameter which is defined by stored radial position data accessible by the processor, the radial position data having a radial position offset and a radial position span, such that the radial position is variable between the radial position offset plus the radial position span to the radial position offset minus the radial position span. Most preferably, the radial position varies at a radial position frequency.

Most preferably, the overall light intensity is also defined by an overall light intensity parameter which is defined by stored overall light intensity data accessible by the processor, the overall light intensity data having an overall light intensity offset and an overall light intensity span, such that the overall light intensity is variable between the overall light intensity plus the overall light intensity span to the overall light intensity offset minus the overall light intensity span. Most preferably, the overall light intensity varies at an overall light intensity frequency.

In a preferred method of operation, the stored programming instructions are operable by the processor to control the operation of the plurality of peripheral light emitting diodes and the central light emitting diode in accordance with a first one of a plurality of stored operating modes for a first time, select a second one of the plurality of stored operating modes, and control the operation of the plurality of peripheral light emitting diodes and the central light emitting diode in accordance with the second one of the plurality of stored operating modes for a second time.

In some versions, the first time is a first constrained random period of time, the second time is a constrained random period of time, and the selection of the second one of the plurality of stored operating modes is on a constrained random basis.

BRIEF DESCRIPTION OF THE DRAWINGS

Preferred and alternative examples of the present invention are described in detail below with reference to the following drawings:

FIG. 7 is a table of exemplary values for a radial parameter for a mode of operation of a preferred electronic candle.

FIG. 8 is a table of exemplary values for an angle parameter for a mode of operation of a preferred electronic candle.

FIG. 9 is a table of exemplary values for an intensity parameter for a mode of operation of a preferred electronic candle.

FIG. 10 is a table of exemplary values for a control parameter for a mode of operation of a preferred electronic candle.

DETAILED DESCRIPTION OF THE PREFERRED EMBODIMENT

Figure 1:
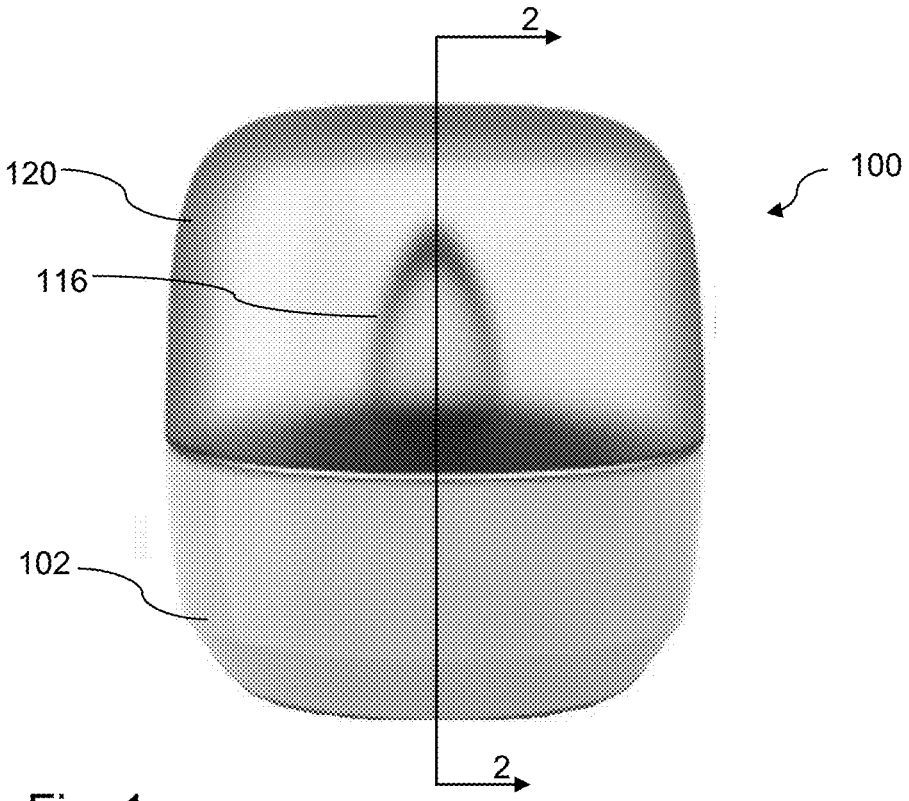
FIG. 1 is a front elevational view of a preferred electronic candle.

A preferred electronic candle is shown in front elevational view in FIG. 1. The candle is electronic and produces light using light emitting diodes (LEDs) or other electronic sources of light, rather than a flame, and is intended to operate the LEDs in a fashion that simulates a burning candle. As shown in FIG. 1, the electronic candle 100 includes a base 102 which is preferably cup-shaped as with a small cylinder that might hold a tea light or other small candle. As shown (see FIG. 2), the base 102 includes a bottom 102*a* and upwardly extending sidewalls 102*b* that terminate in a rim 102*c*, defining an interior space. The preferred electronic candle also includes a dome 120, which is preferably formed from glass or plastic which may be frosted or otherwise configured to provide a diffusing effect for light generated within the electronic candle. In one version, the dome is frosted on an interior surface and is therefore semi-transparent so that the dome is illuminated and creates a sense of glowing while the LEDs are illuminated. An inner bulb 116 may be formed from similar materials in order to diffuse the light from the LEDs, and is intended to create the appearance of a filament or a burning wick, providing an area of concentration of light in the space within the outer dome.

Figure 2:
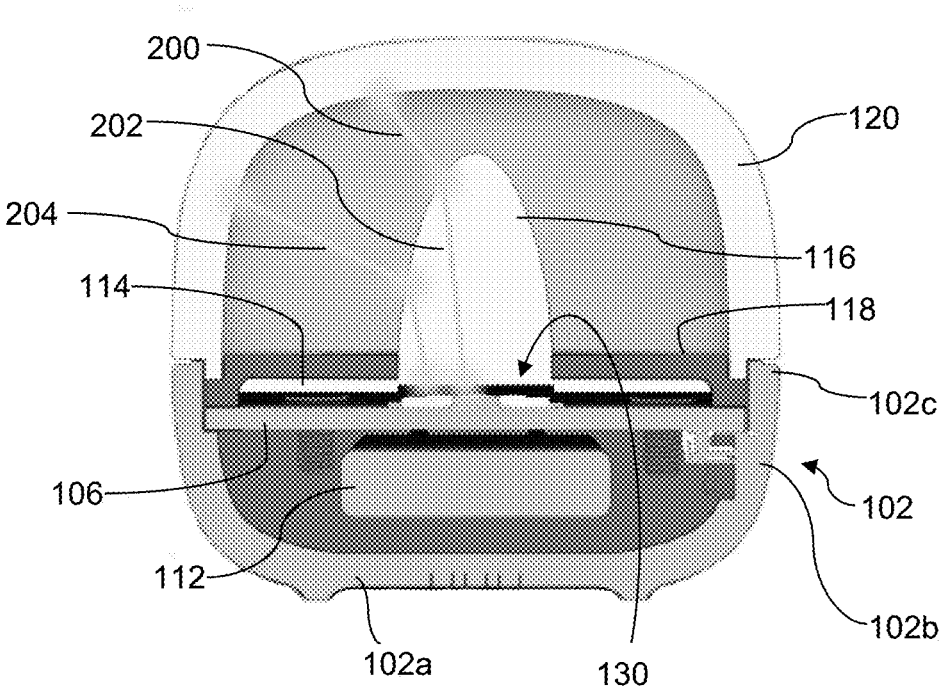
FIG. 2 is a sectional view of the electronic candle of FIG. 1, taken along line 2-2 in FIG. 1.

The preferred electronic candle of FIG. 1 is further shown in FIG. 2, in a sectional view taken along plane 2-2 in FIG. 1. In this sectional view, some additional internal components are visible, including an upper printed circuit board 114 and a lower printed circuit board 106. A battery 112 is illustrated as being positioned beneath the lower printed circuit board. Each of the upper and lower printed circuit boards and the battery are intended to be mounted to and housed within the base. A shroud 118 is positioned toward the upper end of the base and covers the majority of the other components, but having a central opening which allows the bulb to extend through the shroud, further allowing light from the LEDs on the upper printed circuit board to shine into the bulb. The shroud further blocks the LEDs so that they may not be viewed by a user directly, and thus any light from the LEDs is only observable when passing through the bulb. In this view, representative rays of light 200, 202, 204 are shown emanating from LEDs 130 mounted on the upper printed circuit board and shining first toward and through the bulb, then toward and through the dome.

Figure 3:
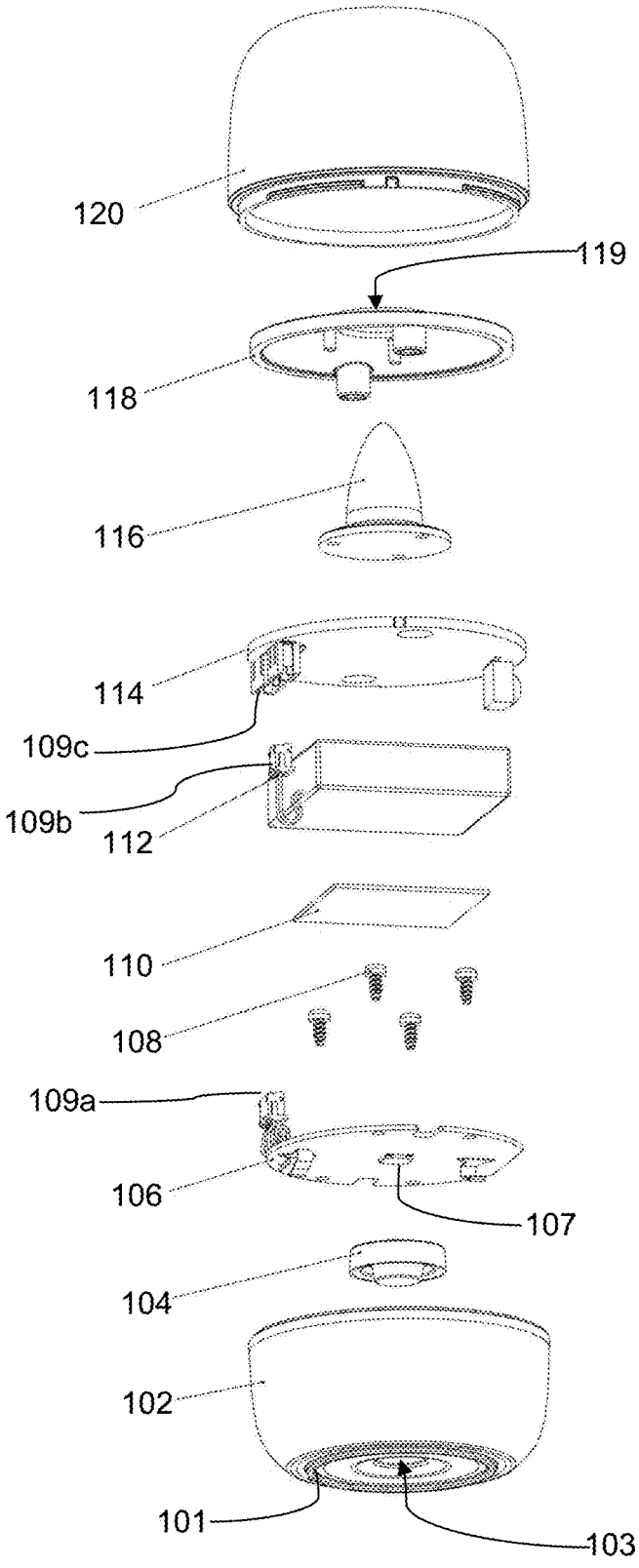
FIG. 3 is an exploded view of a preferred electronic candle.

An exploded view of a preferred electronic candle is shown in FIG. 3. At the bottom, a base 102 is formed generally in a cup shape with an interior volume configured to house the other components described above. A button 104 may be fitted into the base so that a portion of the button extends through a hole 103 formed at the bottom, center of the base. An upper portion of the button is positioned to contact a switch 107 on the lower printed circuit board 106 in order to turn the electronic candle LEDs on or off. It should be appreciated that the light may be switched on or off in other fashions, including by using a remote controller, by motion detection, by a timer, or other means. A plurality of screws 108 are shown, for use in mounting the printed circuit boards and shroud to the base. Other forms of fastening or mounting may be used, such as adhesives, rivets, sonic welding, or others.

A conductive ring 101 may be provided at the bottom of the base to provide a contact point for connection to a recharging station, which may be an optional part of an electronic candle system. In one version, the optional conductive ring is further communicatively coupled to an internal battery to provide a path for the flow of charging current from a charging source to an internal rechargeable battery.

A battery 112 is mounted within the base. In the version of FIG. 2, the battery is illustrated as being mounted to the bottom of the lower printed circuit board, or otherwise at a lower portion of the base. In such a version, an on/off switch may be implemented in a different manner than described above, with a switch or button extending centrally through the bottom of the base. In the example of FIG. 3, the battery 112 may be attached to the upper portion of the lower printed circuit board using an adhesive pad 110. An upper printed circuit board sandwiches the battery between the upper and lower printed circuit boards, and attaches electrically to the battery and the lower printed circuit board via one or more cable harnesses 109*a-c*.

The bulb, or filament, attaches to the top portion of the upper printed circuit board, and is positioned so that the light generated by the LEDs is projected into the interior of the bulb. The shroud 118 covers the upper printed circuit board and includes a central opening 119 to receive the bulb, allowing the bulb to project through the central opening while retaining the base of the bulb between the shroud and the upper printed circuit board. Finally, the dome 120 attaches to the upper rim of the base, preferably in a fashion in which it is removably attached by using a threaded or bayonet arrangement, for example.

Figure 4:
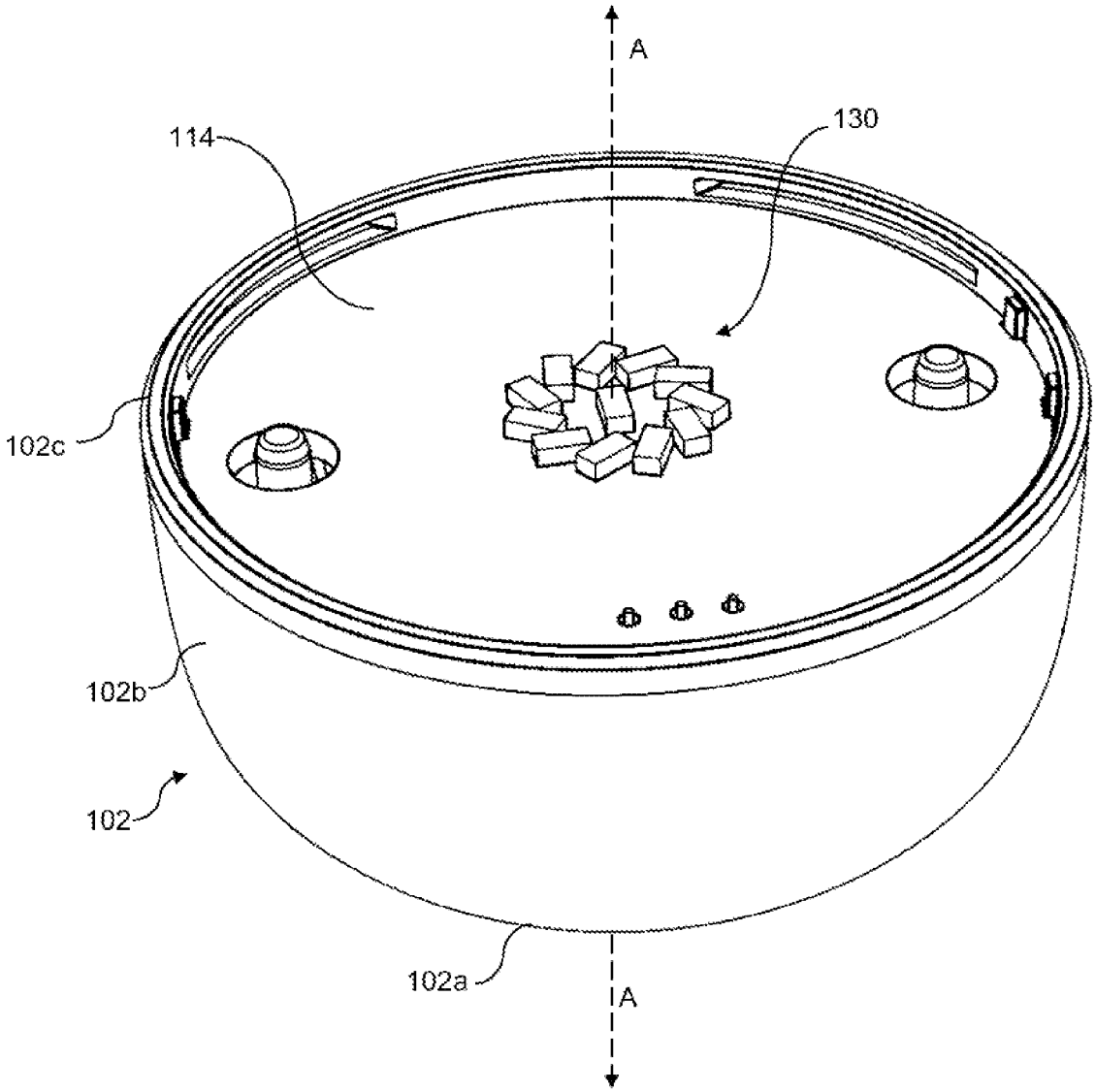
FIG. 4 is a top perspective view of a base for a preferred electronic candle, shown with a dome removed.

An exemplary arrangement of LEDs 130 is shown in the top perspective view of FIG. 4, in which the above components other than the dome, bulb, and shroud are shown mounted to the base. As shown, there is a single central LED and a plurality of peripheral LEDs arranged in a circle surrounding the central LED. The collection of LEDs 130 is also positioned at the center of the circular upper printed circuit board, and therefore at the center of the upper rim of the base. In the particular example of FIG. 4, a total of twelve LEDs is illustrated. In other versions of the invention, either more or fewer LEDs may be used. In yet another version, an additional outer ring of LEDs is provided, such that there is a central LED and two or more concentric rings of LEDs extending outward from the central LED.

Figure 5:
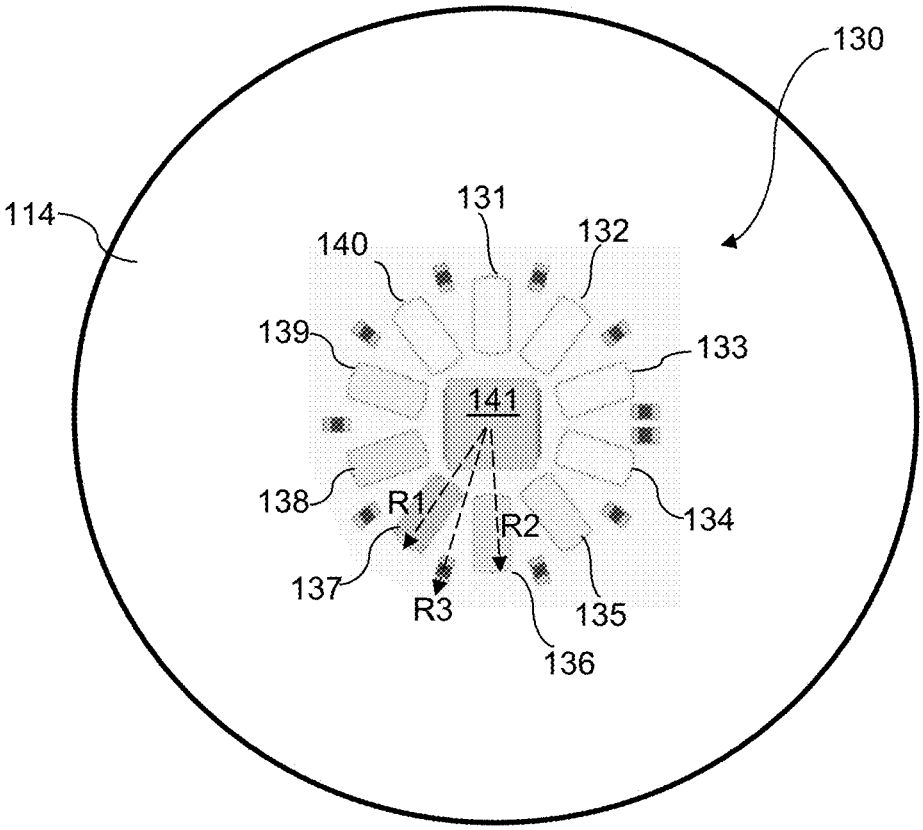
FIG. 5 is a top elevational view of a printed circuit board and a plurality of light emitting diodes for a preferred electronic candle.

FIG. 5 illustrates a top plan view of a preferred upper printed circuit board in which a plurality of LEDs is arranged in a preferred fashion. It should be appreciated that the LEDs are illustrated and described as being mounted to an upper printed circuit board, but they may be mounted in a different fashion other than on a printed circuit board generally, or an upper board specifically. Likewise, there need not be two distinct printed circuit boards in other versions of the invention. In addition, the printed circuit board need not be circular in other versions of the invention.

In the arrangement of FIG. 5, a plurality of LEDs is positioned at the center of the upper printed circuit board 114, with a center LED 141 positioned in the middle. A ring of ten outer LEDs 131-140 surrounds the center LED in a circle. In this example, a total of eleven LEDS is provided, but as noted above a larger or smaller number may be used. In this illustration, the center LED 141 is shaded, indicating that it is illuminated. One of the outer LEDs 137 is also shaded and is illuminated. Four other LEDs 138, 139, 135, 136 are also shaded and therefore illuminated, but at a lower level (that is, a lower light intensity) than the center and first radial LED 137. The other LEDs are not shaded, and are thus indicated as being off. This arrangement has the overall light produced by the plurality of LEDs 130 being more intensely directed to the lower left portion of the board (from the convention of a viewer looking at FIG. 5). This orientation of the light is intended to correspond to that of a candle in which the flame has been blown slightly in that same direction, or for whatever reason has otherwise "flickered" to that position. Other combinations of LEDs may alternatively be illuminated, and in different intensities, to create the impression that the light has flickered or moved to a different position with respect to the center, or that it has returned to a position of greatest intensity at the center.

Figure 6:
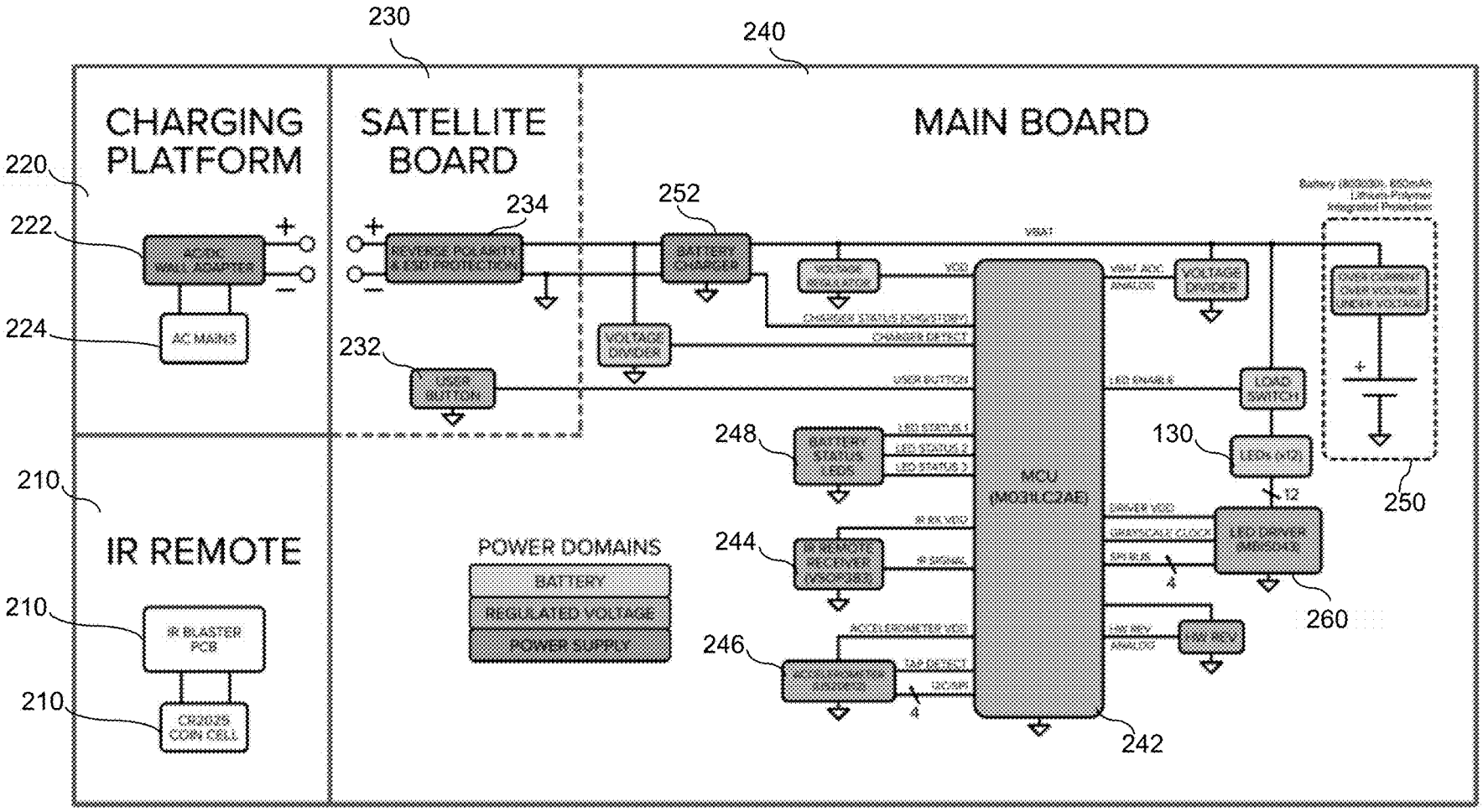
FIG. 6 is a block diagram for components of a preferred electronic candle.

FIG. 6 is a block diagram of preferred electronic components of an electronic candle including optional components of a larger system. In one version, as illustrated, the electronic candle may include an infrared (IR) remote 210 having a printed circuit board supporting applicable components such as a processor and a memory. In some versions, the IR remote may be a simple on/off remote configured to send an IR signal upon pressing an on/off button or switch, with no processor or memory necessary. A battery 210 such as a coin cell battery is provided to power the remote.

In some versions, an electronic candle system may include a charging platform 220. Preferably, the charging platform includes an AC/DC wall adapter 222 configured to plug into an AC power outlet 224. The charging platform (not shown) may include a plurality of locations for providing an electrical connection between a contact area on the charging platform and a complementary charging contact area on the base of an electrical candle, such as the metallic ring 101 as described above. In some versions, several such charging contact areas are provided on a charging platform, such as four distinct charging contact areas. In other versions, the charging platform may not require electrical contacts, and instead may employ inductive or other wireless forms of charging.

In the system as illustrated, the electronic candle includes two separate printed circuit boards (including an upper and lower board as described above), though in other versions a single board may be used. In the exemplary version further illustrated with reference to FIG. 6, a satellite board 230 corresponds to the lower printed circuit board 106 of FIGS. 2 and 3. The satellite board 230 includes a user button 232, corresponding to the contact switch 107 as illustrated in FIG. 3. The satellite board 230 further includes a reverse polarity and overvoltage protection circuit 234 which is configured to block negative supply voltages and to protect the components on the main board 240 from undesirably high (or negative) supply voltages.

The main board 240 includes a microcontroller 242 having internal memory with stored programming instructions operable by the microcontroller to implement the controlled operation of LEDs as described. In some versions, additional external memory may be used (though not illustrated in the preferred version of the invention). Although a microcontroller is illustrated and incorporated in a preferred version of the invention, it should be appreciated that any computer processor may be used. Within this description, the term "processor" should be understood to generally include any of a variety of integrated circuit-based computers having one or more processor cores, such as microcontrollers, computers, digital signal processors, controllers, and the like. It should further be appreciated that a number of components are illustrated and described as being included on the main board, but in other versions any of the illustrated components may be mounted other than on the main board, such as on other locations within the base 102. Likewise, the system is described as having programming instructions stored in a memory and operable by the processor, and in some versions the memory is internal to the processor while in other versions the memory is external to the processor or is a combination of internal and external memory.

In a version in which a remote controller is provided (such as the IR remote 210), the main board may include an IR remote receiver 244. The IR remote receiver is communicatively coupled to the processor 242 to provide a signal to the processor indicating an on or off condition. Optionally, the main board may include an accelerometer 246. In such a version, the accelerometer is configured to detect an acceleration force (such as shaking or tapping on the electronic candle by a user, perhaps in a required format of multiple taps) and to provide a signal to the controller accordingly. Upon receipt of such a signal from the accelerometer, the processor will cause the LEDs to turn on or off (and to initiate or end the lighting modes as described below) in the same fashion as with an on/off button or switch.

A battery status LED provides an illuminated indication of the status of charge of a battery 250. A battery charger 252 is provided in the illustrated example, and is coupled to the battery and to the power input, which is the AC power outlet 224, through the wall adapter 222, for charging the battery. Although a rechargeable battery is preferred and is described and illustrated, in other versions a standard non-rechargeable battery may be used.

An LED driver 260 is coupled to the processor and to the plurality of LEDs 130, causing the LEDs to turn on and off, and at controlled illumination levels, under control of the processor. In one version of the invention, up to five LEDs are illuminated at any time, at varying degrees of intensity within those five LEDs, in a controlled sequence to simulate the flickering of a candle. Most preferably, the illuminated LEDs will be adjacent one another and controlled to simulate radial, angular, and intensity variations of the location of the light with respect to a central axis A-A (see FIG. 4) extending through the middle of the central LED, and preferably also through the center of the base 102.

A memory within or otherwise accessible by the processor contains stored programming instructions causing the LEDs to illuminate under control of the processor, which in a preferred version is in accordance with exemplary modes defined by the data in FIGS. 7-11. Actual flame candles have movement of the flame which may vary between different modes, including a quiet mode of slow movement within a constrained range, a windblown mode characterized by fast changes in direction and intensity, an oscillating mode with quick changes in intensity but little directional movement, and a gentle mode with moderate changes in position and intensity. A candle may move in a manner consistent with one of these modes for a period between a second or two to perhaps several seconds, then change to a different mode and thereafter continue changing to varying modes of illumination for such brief periods of time.

In one version of the invention, the memory contains data used to control the illumination of the LEDs in accordance with such modes by controlling the apparent radial position, angular position, and intensity of the simulated flame, and further to control the selection of a particular mode of operation and the duration of that mode. In one form, as illustrated, the data may be represented in tabular form and stored in the memory as with a lookup table, such as shown in FIGS. 7-10.

An apparent flame position is defined as a center of light intensity, taking into account the intensity of each of the LEDs in the electronic candle. The apparent flame position may be at the center of the plurality of LEDs, or may be outward from the center because of the illumination of one or more of the peripheral LEDs. When the apparent flame position is outward, it may be in a particular direction, such as toward the lower left as illustrated with reference to FIG. 5. The apparent flame position is thus defined as being at a particular angle (between 0 and 360 degrees around the center), and at a particular distance from the center along the given radial. In addition, the intensity of the apparent flame can vary at a given angular and radial position, depending on the illumination intensity of the LEDs.

FIG. 7 illustrates an exemplary table of data for a radial position parameter. The radial position parameter controls the apparent position of the flame from the center to the outer rim of the LEDs. For example, if the center LED 141 (see FIG. 5) is on but the surrounding LEDs 131-140 are all off, the light (or the perceived flame) is at the central axis. Illuminating one of the LEDs in the outer ring, such as LED 137, will cause the apparent position of the flame to move outward and along a first radial R1 extending from the central axis (or the center LED) toward the illuminated LED 137. Variations in the intensity as between the center LED and the outer LED will cause the apparent radial position of the flame to move outward or inward, along the selected radial R1. Thus, for example, the full illumination of outer LED 137 while turning off the center LED 141 will cause the apparent flame to move fully outward along the radial R1. Changing the relative illumination of the center LED 141 and outer LED 137 can cause the center of intensity of the light to move to any desired location along the radial R1. Likewise, illuminating only the center LED 141 and a different outer LED 136 can cause the apparent flame location to move to any location along a second radial R2. Still further, illuminating a combination of the center LED and both outer LEDs 136 and 137 can cause the apparent location of the flame to move along a third radial R3, which is located between LEDs 136 and 137. Yet other combinations of LED illumination can produce light corresponding to an apparent flame position at different radial positions.

In the table of FIG. 7, there are four rows of numerical values, labeled in a left-most column as rows 0, 1, 2, and 3. Each row corresponds to a different mode of operation, and thus in the illustrated example there are four modes. In other versions, there may be more modes or fewer modes. The table further shows three main categories, including div, span, and offset. The max and min div values (or frequency constraint values) are used by the processor to constrain the frequency of randomization of the parameter. The lower the div value, the faster the parameter can change. The processor uses a random value to determine the frequency at which the radial parameter can change, but the randomization is constrained by the max and min div values for the particular mode.

FIG. 7 also shows max and min span values, and the span determines the range over which the parameter can change. The radial parameter addresses movement along a single radial (which, depending on the defined span, could extend across the center so that a radial is actually a diameter), from the center outward or from a peripheral location in a direction toward the center. The span thus defines the distance of movement of the apparent flame location along the radial (which again could be a diameter). As with the frequency, the span is determined by the processor in a random fashion but is constrained by the min and max values for the given mode.

FIG. 7 lastly includes offset min and max values. The offset value is a neutral or pre-biased location, such that the allowed movement of the apparent flame location along a radial can vary from the offset+span to offset−span. Again, the actual offset is randomized but constrained between the min and max values. Thus, the radial control data defines the manner of operation of the radial position parameter. In particular, it defines the apparent position of the flame along a particular radial, including the distance of travel along the radial and the frequency of such movement along the radial.

FIG. 8 provides a similar approach to the control of the angular position of the apparent flame. While the radial position parameter was concerned with movement along a single radial (for example, along one of R1, R2, or R3), the angular position parameter is concerned with the angular position of the apparent flame. In other words, the angular position parameter is concerned with the selection of one of R1, R2, or R3 (or yet any other radial around the circle of LEDs). As with FIG. 7, the table of FIG. 8 provides data in four rows corresponding to four modes, and includes div, span, and offset values. The div value again controls the frequency at which the parameter can change, with min and max values constraining the randomly-determined value. The higher values indicate a slower frequency of change, and in the preferred version the angular position is constrained by the div values so that the radial position changes with a greater frequency than the angular position.

The span values in the angular position table vary between 0 and 360. In the first row (labeled row 0), the min and max span values are 75 and 120. Any radial may be designated as a zero degree radial, and the other radials may be assigned values up to 360 degrees from the zero degree radial by proceeding either clockwise or counterclockwise in a full circle. In one example, Radial R2 as illustrated in FIG. 5 could be designated as the zero degree radial, using a clockwise convention to reach 360 degrees and complete the circle. Mode 0 from FIG. 8 constrains the angular position of the apparent flame to locations that are between a radial located at 75 degrees (roughly corresponding to LED 138) and a radial located at 120 degrees (corresponding to the vicinity of LED 139). In modes 1 and 2, the min and max are 0 and 360, thereby allowing the position to move along any radial in the circle. The offset min and max define a constraint on the randomized minimum and maximum offset, as above, and in the illustrated versions the min and max are 0 and 360. The actual angular movement of the apparent flame in a given mode can therefore vary between offset+span and offset−span, at a frequency constrained as described above. In addition, the radial position parameter and angular position parameter work in concert with each of them changing during the operation of the mode, in accordance with the frequency determination.

FIG. 9 provides a preferred table of data corresponding to an intensity parameter which is indicative of the overall intensity of the apparent flame. In one version, the intensity is equal to the sum of all of the LED illumination values. As with the other parameters above, there are min and max frequency constraint values, min and max span values, and min and max offset values. The intensity is therefore varied in a particular mode at a random frequency constrained by the min and max frequency constraint (or div) values, between offset+span and offset−span values which are also randomized and constrained by their min and max values. In one version, the system determines a point location within the plurality of LEDs as the center of intensity, using the angle and radius. The system then assigns intensity values to the LEDs based on their distance from that point, preferably including values assigned to the center LED, the two LEDs on either side of the center of intensity (if no single LED is at the center), and the two LEDs outside of the above-indicated LEDs. The total illumination of all five of the above-described LEDs (or for a single LED if the one single LED is determined to be at the center of intensity) is summed and matched to the computed intensity.

FIGS. 7-9 present data for four different modes of operation, each of the modes having defined radial, angle, and intensity behavior. In a preferred version, each mode is distinct from the other modes in a discernible way in order to mimic the different modes of flicker for a true flame. Thus, in one example, the data define a first mode consistent with a quiet mode of slow movement within a constrained range (thereby having low frequencies of change, with span and offset values that allow for relatively small movements), a windblown mode characterized by fast changes in direction and intensity (thereby having data corresponding to high frequencies of change, and larger allowed movements in the radial, angular, and intensity parameters), an oscillating mode with quick changes in intensity but little directional movement (defined by a high allowed frequency and a wider permitted range in intensity, but constrained radial and angular parameters), and a gentle mode with moderate changes in position and intensity (defined by moderate data values allowing for mid-level frequencies of change and mid-level angular, radial, and intensity changes).

FIG. 10 presents an illustrative control table which is used to control the probability that a given mode will be selected and implemented. It further controls the duration of operation of the mode once it is selected. In one example, the table includes duration values (labeled "dur") which further include min and max values defining a number of seconds during which the mode may operate. The length of operation of the mode is randomized, and constrained by the min and max values.

The selection of any mode for operation is also randomized but biased by a probability that a particular mode will be selected. Thus, the control data preferably includes a probability value (labeled "prb") which is the preset probability that the particular mode will be selected. In the example of FIG. 10, mode 0 has a 40 percent probability of selection, mode 1 a 20 percent probability, and mode 2 has a 40 percent probability. The final column, labeled "mod," is a control value which can turn off or on each mode.

Figure 11:
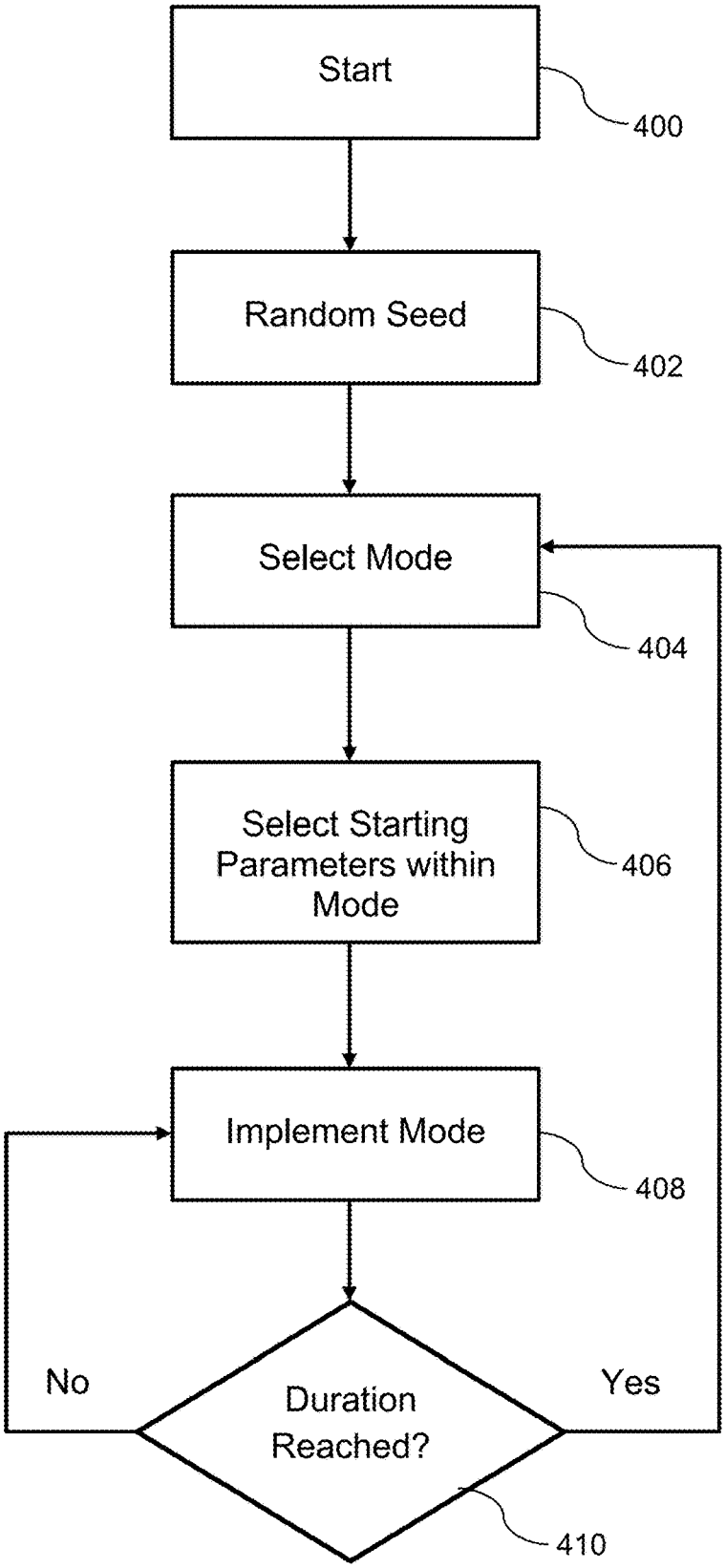
FIG. 11 is a flow diagram for a preferred method of operation of an electronic candle.

The movement of the flame is further described with reference to the flow diagram of FIG. 11, which illustrates a process implemented by stored programming instructions operated on by the processor, using the parameter values as described above. The process starts at a first block 400, such as when the light is first switched on via the remote control or a switch as described above. At this step, in one version the illumination is taken from off, or zero, to an initial value which is stored in the processor memory. In one version, the overall intensity at the startup step is taken to a value which is halfway between zero and the maximum overall brightness value of the combined LEDs. In another version, the startup ramps the intensity to a max value and then drops back to a typical value, to mimic the "flare up" of a normal candle when being lit.

The process then proceeds to a next block 402 in which the processor generates a random seed for use in the random functions as described above. For example, the random seed may read one or more analog inputs from any of the sensors such as a battery voltage sensor, using the least significant bits to ensure a unique random seed. The initial use of the random seed further ensures that multiple lights will not be synchronized in their behavior if turned on at the same time.

The process next proceeds to a block 404, using a random function to select one of the modes for operation. With reference to the tables in FIGS. 7-10, this may be the selection of modes 0, 1, 2, or 3. It should be understood that the illustrated modes are representative, and that more or fewer modes may be stored for selection and use. Likewise, the values shown in the representative modes are also illustrative, and other modes may have different stored parameter values. In a preferred version, the system includes three or more, or preferably four, distinct modes. In one example, the system includes a first mode providing slow movement within a constrained range, a second mode providing a windblown effect characterized by fast changes in direction and intensity, a third mode providing an oscillating effect with quick changes in intensity but little directional movement, and a fourth mode of gentle movement with moderate changes in position and intensity.

As described above, the mode of operation is selected using the probability values assigned to the defined modes, such as with the values as shown in FIG. 10. At this stage, the process also determines a random (but constrained) duration for the chosen mode, in the manner as described above.

Once the starting mode and duration are determined the process proceeds to a next block 406, in which the stored programming instructions in the processor cause the selection of radial position, angular position, and intensity parameters. For a given radial position, angular position, and overall intensity, the processor will determine the intensity value for each of the LEDs 130. At lower intensity values, a smaller number of LEDs in the vicinity of the determined radial and angular position will be sufficient to produce the overall intensity. But at higher overall intensity values, the local LEDs must be illuminated to a maximum extent, and a greater number of surrounding LEDs must also be illuminated. By controlling the number of illuminated LEDs and the intensity for each separate LED, the desired overall intensity can be achieved while maintaining the chosen radial and angular position.

The process continues at a block 408, starting the implementation of the selected mode by illuminating the LEDs as necessary to achieve the apparent flame position as defined by the radial and angular positions and the overall intensity. At the frequency rate as defined by the mode and randomized within the definition of the mode, the apparent flame location is continually changed in accordance with newly calculated radial offset, angular offset, and intensity values. The chosen mode is continued to be employed in this manner for the duration of the mode as determined above.

As noted above, within the operation of the mode, the process continually determines new apparent flame location parameters, at a rate sufficient to implement adjusted parameters in accordance with the determined frequencies. As indicated by a decision block 410, the process continually evaluates whether the duration has lapsed, and if not it continues to implement the selected mode. Once the duration has been reached, the process returns to block 404 for the selection of a different mode of operation. Although FIG. 11 illustrates the selection as occurring temporally after the completion of the duration for a given mode, it should be understood that a next mode can be selected at any time, including before the completion of the currently operating mode. In addition, in the preferred embodiment the selection of modes is performed in random way. In other versions the arrangement of modes can be preset in a pseudorandom way, such as by a table containing an order of implementation of modes in which the order is a lengthy pseudorandom list. The new mode is then implemented in the same fashion as above, with the process moving to block 406 to select starting parameters for the new mode. The above process continues to cycle through in this process until turned off or the battery is depleted.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An electronic candle, comprising:

a base;

a printed circuit board supported by the base, the printed circuit board having a plurality of peripheral light emitting diodes arranged around a central light emitting diode;

a bulb covering the plurality of peripheral light emitting diodes and the central light emitting diodes; and a shroud surrounding the bulb, wherein light from the plurality of peripheral light emitting diodes and the central light emitting diode is directed through the bulb and is blocked by the shroud.

2. The electronic candle of claim 1, further comprising a translucent dome supported by the base and surrounding the bulb.

3. The electronic candle of claim 2, wherein the translucent dome is frosted and is semi-transparent.

4. The electronic candle of claim 2, wherein the base comprises a bottom and upwardly extending sidewalls that terminate in a rim, defining an interior space.

5. The electronic candle of claim 4, wherein the base is cup shaped.

6. The electronic candle of claim 1, wherein the printed circuit board is mounted within the base.

7. The electronic candle of claim 1, further comprising a processor coupled to the plurality of peripheral light emitting diodes and the central light emitting diode, the processor having stored programming instructions to control the illumination of the plurality of peripheral light emitting diodes and the central light emitting diode.

8. An electronic candle, comprising:

a base;

a plurality of light emitting diodes;

a bulb covering the plurality of light emitting diodes; and a processor coupled to the plurality of light emitting diodes, the processor having stored programming instructions to control the illumination of the plurality of light emitting diodes;

wherein the electronic candle includes an apparent flame position defined as a center of light intensity produced by the combination of the plurality of light emitting diodes, and further wherein the stored programming instructions are operable by the processor to vary the location of the apparent flame position by controlling the intensity of illumination of the plurality of light emitting diodes.

9. The electronic candle of claim 8, wherein the stored programming instructions are further operable by the processor to control an angular position and a radial position of the apparent flame position.

10. The electronic candle of claim 8, wherein the stored programming instructions are further operable by the processor to vary an overall light intensity, the angular position, and the radial position.

11. The electronic candle of claim 10, wherein:

the angular position is defined by an angular position parameter which is defined by stored angular position data accessible by the processor;

the angular position data having an angular position offset and an angular position span, wherein the angular position is variable between the angular position offset plus the angular position span to the angular position offset minus the angular position span; and further wherein the angular position varies at an angular position frequency.

12. The electronic candle of claim 11, wherein:

the radial position is defined by a radial position parameter which is defined by stored radial position data accessible by the processor;

the radial position data having a radial position offset and a radial position span, wherein the radial position is variable between the radial position offset plus the radial position span to the radial position offset minus the radial position span; and further wherein the radial position varies at a radial position frequency.

13. The electronic candle of claim 10, wherein:

the radial position is defined by a radial position parameter which is defined by stored radial position data accessible by the processor;

the radial position data having a radial position offset and a radial position span, wherein the radial position is variable between the radial position offset plus the radial position span to the radial position offset minus the radial position span; and further wherein the radial position varies at a radial position frequency.

14. The electronic candle of claim 10, wherein:

the overall light intensity is defined by an overall light intensity parameter which is defined by stored overall light intensity data accessible by the processor;

the overall light intensity data having an overall light intensity offset and an overall light intensity span, wherein the overall light intensity is variable between the overall light intensity plus the overall light intensity span to the overall light intensity offset minus the overall light intensity span; and further wherein the overall light intensity varies at an overall light intensity frequency.

15. The electronic candle of claim 10, further comprising a plurality of stored operating modes accessible by the processor, each of the operating modes defining a range of variation and a frequency of variation for each of the overall light intensity, the angular position, and the radial position, the stored programming instructions being operable by the processor to control the operation of the plurality of light emitting diodes in accordance with the stored operating modes.

16. The electronic candle of claim 15, wherein the stored programming instructions are further operable by the processor to:

control the operation of the plurality of light emitting diodes in accordance with a first one of the plurality of stored operating modes for a first time;

select a second one of the plurality of stored operating modes; and control the operation of the plurality of light emitting diodes in accordance with the second one of the plurality of stored operating modes for a second time.

17. The electronic candle of claim 15, wherein the first time is a first constrained random period of time, the second time is a constrained random period of time, and the selection of the second one of the plurality of stored operating modes is on a constrained random basis.

18. The electronic candle of claim 8, further comprising a plurality of stored operating modes accessible by the processor, each of the operating modes defining a range of variation and a frequency of variation for each of an overall light intensity, an angular apparent flame position, and a radial apparent flame position, the stored programming instructions being operable by the processor to control the operation of the plurality of light emitting diodes in accordance with the stored operating modes.

19. The electronic candle of claim 18, wherein the plurality of modes comprises a first mode providing slow movement of the apparent flame position within a constrained range, a second mode providing a windblown effect characterized by fast changes in direction and intensity of the apparent flame position, a third mode providing an oscillating effect with quick changes in intensity but little directional movement of the apparent flame position, and a fourth mode of gentle movement with moderate changes in position and intensity of the apparent flame position.

20. The electronic candle of claim 18, further comprising stored programming instructions operable by the processor to:

control the operation of the plurality of light emitting diodes in accordance with a first one of the plurality of stored operating modes for a first time;

select a second one of the plurality of stored operating modes; and control the operation of the plurality of light emitting diodes in accordance with the second one of the plurality of stored operating modes for a second time.

21. The electronic candle of claim 20, wherein the processor is a microprocessor, and wherein the stored programming instructions are internal to the microprocessor.

* * * * *